US009852854B1

(12) United States Patent
Wang

(10) Patent No.: US 9,852,854 B1
(45) Date of Patent: Dec. 26, 2017

(54) SLIM-TYPE KEYBOARD

(71) Applicant: PRIMAX ELECTRONICS LTD., Taipei (TW)

(72) Inventor: Yi-Chen Wang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 15/257,709

(22) Filed: Sep. 6, 2016

(30) Foreign Application Priority Data

Jun. 8, 2016 (TW) ..... 105118138 A

(51) Int. Cl.
*H01H 13/06* (2006.01)
*H01H 13/7065* (2006.01)

(52) U.S. Cl.
CPC ..... *H01H 13/7065* (2013.01); *H01H 13/06* (2013.01); *H01H 2205/032* (2013.01); *H01H 2215/004* (2013.01); *H01H 2239/034* (2013.01); *H01H 2239/056* (2013.01); *H01H 2239/074* (2013.01)

(58) Field of Classification Search
CPC ..... H01H 13/7065; H01H 13/7073; H01H 13/704; H01H 13/06; H01H 2237/004
USPC ..... 200/341, 302.2
See application file for complete search history.

(56) References Cited

U.S. PATENT DOCUMENTS 5,892,652 A * 4/1999 Bony ..... H01H 13/70 200/246
8,212,162 B2 * 7/2012 Zhou ..... H01H 13/7057 200/5 A
8,810,438 B2 * 8/2014 Tsai ..... H01H 9/18 200/315
9,111,700 B2 * 8/2015 Liu ..... H01H 13/52
9,477,027 B2 * 10/2016 Tsai ..... H01H 13/83
9,508,505 B2 * 11/2016 Hsu ..... H01H 3/125
2008/0277257 A1 * 11/2008 Huang ..... H01H 13/7065 200/345
2008/0296141 A1 * 12/2008 Ogatsu ..... H01H 13/705 200/535

* cited by examiner

*Primary Examiner* — Felix O Figueroa
(74) *Attorney, Agent, or Firm* — Kirton McConkie; Evan R. Witt

(57) ABSTRACT

A slim-type keyboard includes a first flexible layer, a pressed frame and a circuit board assembly. The first flexible layer includes plural pressed regions. The pressed frame includes plural cantilever strips. The circuit board assembly includes plural dome switches. The plural cantilever strips are covered by the first flexible layer. The pressed regions are aligned with the cantilever strips and the dome switches, respectively. When one of the pressed regions is pressed, the cantilever strip is pushed down to trigger the corresponding dome switch. Each cantilever strip includes a U-shaped groove and a suspension end. The U-shaped groove opens to the suspension end. Consequently, the tactile feel of pressing the cantilever strip is improved.

9 Claims, 6 Drawing Sheets

SLIM-TYPE KEYBOARD

FIELD OF THE INVENTION

The present invention relates to a slim-type keyboard, and more particularly to a slim-type keyboard with cantilever strips.

BACKGROUND OF THE INVENTION

As known, keyboards are indispensable input devices for people in the modern societies. Generally, plural keys are installed on a top surface of the keyboard. Via the keyboard, the user can press one or more keys to input a command. However, the key of the conventional keyboard has to be provided with a scissors-type connecting element. Since the scissors-type connecting element occupies a lot of space, the thickness of the conventional keyboard is larger. For solving this drawback, a slim-type keyboard is introduced into the market. The slim-type keyboard is equipped with a cantilever structure in replace of the scissors-type connecting element. Generally, the cantilever structure comprises a connection end and a suspension end. The cantilever structure is disposed under the corresponding key to support the key. That is, the bottom surface of each key is contacted with the connection end and the suspension end.

However, the use of the cantilever structure as the support structure of the key still has some drawbacks. For example, when the key is pressed by the user's finger, the connection end and the suspension end are correspondingly moved downwardly. The traveling distance (i.e., the downwardly movable distance) of the suspension end is certainly larger than the traveling distance of the connection end. Consequently, while a single key is pressed down, the key region near the suspension end and the key region of the connection end provide different tactile feels to the user. Under this circumstance, the user feels the discomfort of operating the keyboard.

Moreover, there is a vacant region between every two adjacent keys of the conventional keyboard. The foreign matters such as dust particles or water drops readily fall down to a circuit board of the keyboard through the vacant region. The dust particles or water drops may result in a poor contact problem of the circuit board or cause damage of the circuit board. Therefore, the conventional keyboard needs to be further improved.

SUMMARY OF THE INVENTION

The present invention provides a slim-type keyboard with specially-designed cantilever strips. The cantilever strip comprises a U-shaped groove. When different regions of the cantilever strip are pressed, the tactile feel is identical.

In accordance with an aspect of the present invention, there is provided a slim-type keyboard. The slim-type keyboard includes a first flexible layer, a pressed frame and a circuit board. The first flexible layer includes plural pressed regions. The pressed frame is disposed under the first flexible layer. The pressed frame includes plural hollow regions and plural cantilever strips. The plural cantilever strips are defined by the plural hollow regions. Each of the plural cantilever strips includes a U-shaped groove, a connection end and a suspension end. The U-shaped groove opens to the suspension end. The plural cantilever strips are covered by the first flexible layer. The pressed regions are disposed over and aligned with the corresponding cantilever strips. When one of the plural pressed regions is pressed, the corresponding cantilever strip is pushed downwardly. The circuit board assembly includes a circuit board and plural dome switches. The plural dome switches are disposed on the circuit board. The plural cantilever strips are disposed over and aligned with the corresponding dome switches. When one of the plural cantilever strips is pushed downwardly, the corresponding dome switch is triggered.

In an embodiment, the first flexible layer is a one-piece structure, and the first flexible layer is made of a plastic material, a leather material or a fabric material.

In an embodiment, the plural pressed regions are protruded upwardly from a top surface of the first flexible layer, and a symbol or a character is printed on the corresponding pressed region. Alternatively, the plural pressed regions are formed on a top surface of the first flexible layer, and a symbol or a character is printed on the corresponding pressed region.

In an embodiment, the slim-type keyboard further includes a second flexible layer, and the second flexible layer is disposed under the circuit board assembly. A peripheral region of the first flexible layer and a peripheral region of the second flexible layer are attached on each other. An accommodation space is defined by the first flexible layer and the second flexible layer collaboratively. The pressed frame and the circuit board assembly are accommodated within the accommodation space.

In an embodiment, the circuit board assembly further includes a supporting plate, and the supporting plate is arranged between the circuit board and the second flexible layer. The supporting plate is a glass-reinforced epoxy laminate substrate (FR-4), a plastic substrate or a metal substrate, and the circuit board is a membrane circuit board.

In an embodiment, the circuit board includes a first slot, and the supporting plate includes a second slot. After the connection end of the cantilever strip is penetrated downwardly through the first slot and the second slot, the connection end is bent to form the bent structure. The bent structure has a top surface and a bottom surface. The top surface of the bent structure is contacted with the supporting plate. The bottom surface of the bent structure is contacted with the second flexible layer.

In an embodiment, the second flexible layer comprises a concave structure, and the bent structure is accommodated within the concave structure of the second flexible layer.

In an embodiment, the domes switches are metal dome switches or rubber dome switches.

In an embodiment, the slim-type keyboard fourth includes a first adhesive, and the first adhesive is arranged between the first flexible layer and the pressed frame. The first flexible layer and the pressed frame are combined together through the first adhesive.

In an embodiment, the slim-type keyboard fourth includes a second adhesive, and the second adhesive is arranged between the circuit board assembly and the second flexible layer. The circuit board assembly and the second flexible layer are combined together through the second adhesive.

In an embodiment, the circuit board is used as a supporting plate, and the supporting plate is a glass-reinforced epoxy laminate substrate (FR-4). The plural dome switches are disposed on the supporting plate.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
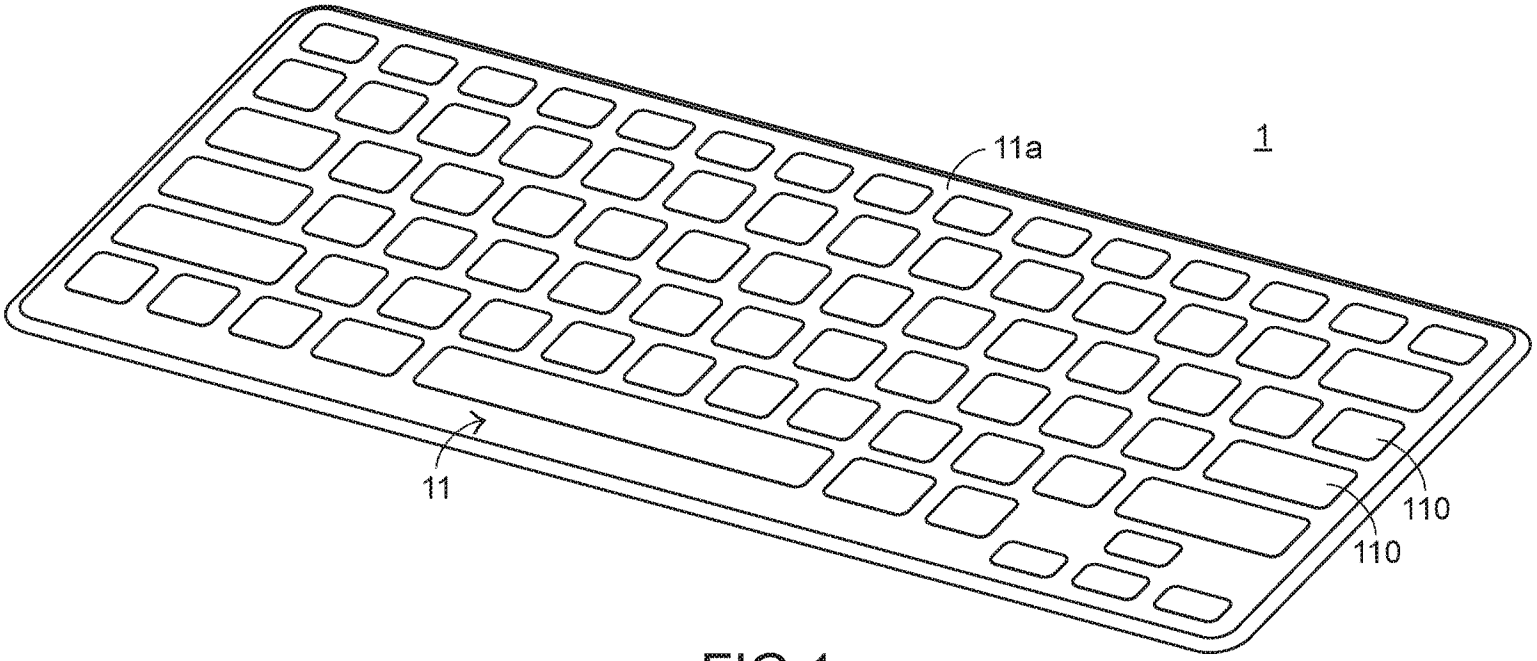
FIG. 1 is a schematic perspective view illustrating the appearance of a slim-type keyboard according to an embodiment of the present invention.

FIG. 1 is a schematic perspective view illustrating the appearance of a slim-type keyboard according to an embodiment of the present invention. As shown in FIG. 1, the slim-type keyboard 1 of the present invention has no scissors-type connecting element. Consequently, the thickness of the keyboard of the present invention is reduced when compared with the conventional keyboard. The slim-type keyboard 1 comprises a first flexible layer 11 to be pressed by a user. The first flexible layer 11 comprises plural pressed regions 110. A symbol or a character is printed on each pressed region 110. Consequently, the pressed region 110 can be recognized by the user. When the pressed region 110 is pressed by the user, a corresponding command is generated. In an embodiment, the pressed region 110 is protruded upwardly from a top surface 11*a* of the first flexible layer 11. Alternatively, in another embodiment, the pressed region 110 is formed on the top surface 11*a* of the first flexible layer 11 and at the same level as the top surface 11*a* of the first flexible layer 11.

Figure 2:
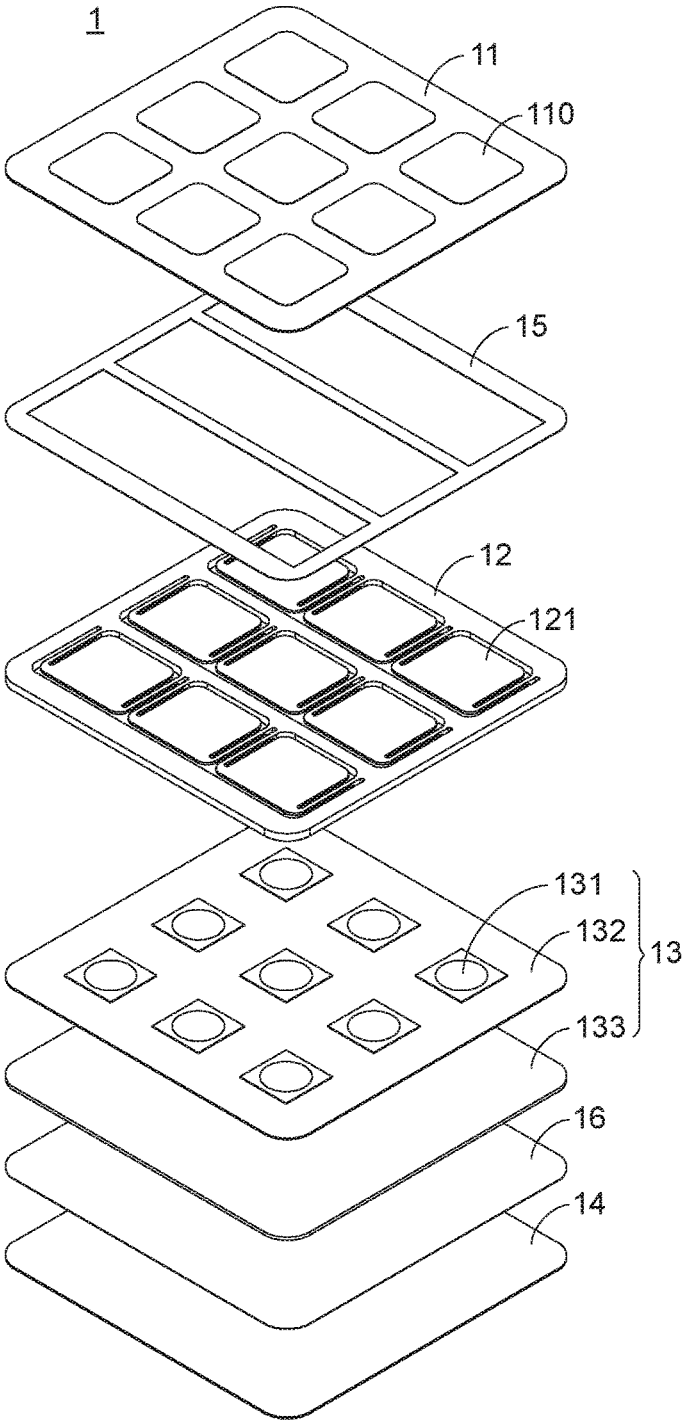
FIG. 2 is a schematic exploded view illustrating a portion of the slim-type keyboard according to a first embodiment of the present invention.
Figure 3:
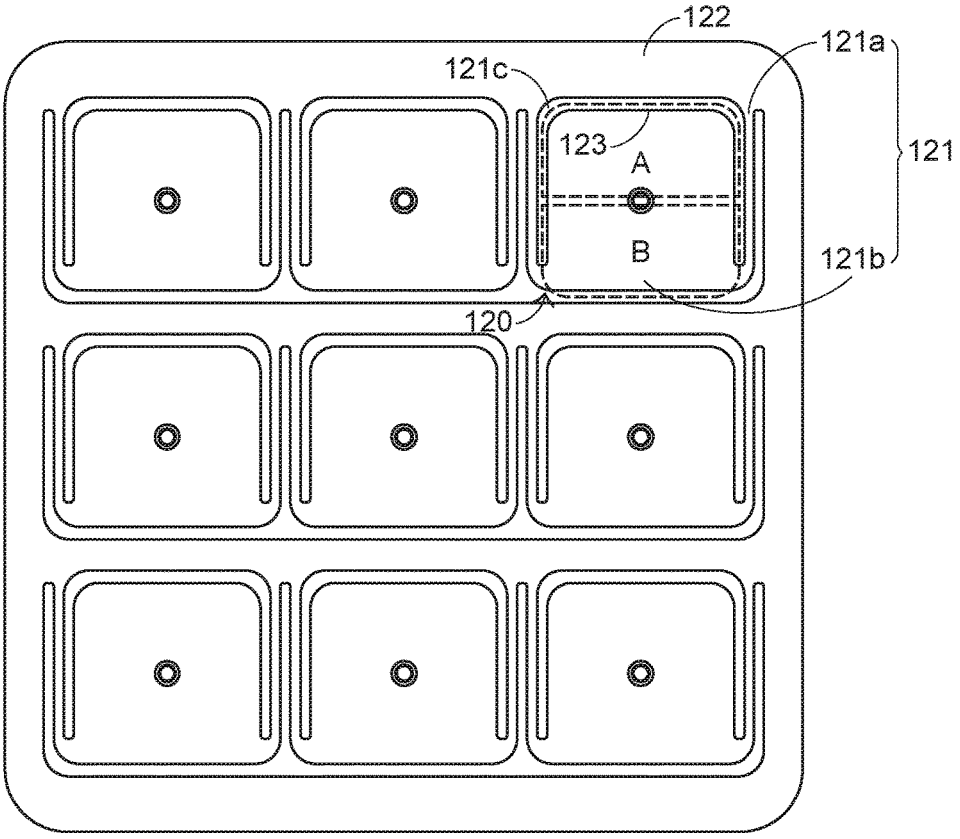
FIG. 3 is a schematic top view illustrating the pressed frame of the slim-type keyboard according to the first embodiment of the present invention.

FIG. 2 is a schematic exploded view illustrating a portion of the slim-type keyboard according to a first embodiment of the present invention. FIG. 3 is a schematic top view illustrating the pressed frame of the slim-type keyboard according to the first embodiment of the present invention. For succinctness, only nine pressed regions 110 of the slim-type keyboard 1 are shown in FIGS. 2 and 3. Please refer to FIGS. 2 and 3. The slim-type keyboard 1 comprises the first flexible layer 11, a pressed frame 12, a circuit board assembly 13 and a second flexible layer 14. For assembling the slim-type keyboard 1, the peripheral region of the first flexible layer 11 and the peripheral region of the second flexible layer 14 are attached on each other. Consequently, an accommodation space is defined by the first flexible layer 11 and the second flexible layer 14 collaboratively. The pressed frame 12 and the circuit board assembly 13 are accommodated within the accommodation space. That is, the components of the slim-type keyboard 1 from top to bottom include the first flexible layer 11, the pressed frame 12, the circuit board assembly 13 and the second flexible layer 14 sequentially.

Preferably but not exclusively, the bottommost layer of the slim-type keyboard 1 is the second flexible layer 14. Optionally, the second flexible layer 14 is omitted. Under this circumstance, the circuit board assembly 13 is the bottommost layer of the slim-type keyboard 1. Alternatively, the second flexible layer 14 is replaced by a rigid layer.

Please refer to FIG. 3 again. The pressed frame 12 comprises a frame body 122, plural cantilever strips 121 and plural hollow regions 120. The contours of the cantilever strips 121 are defined by the hollow regions 120. That is, a connection end 121*a* and a suspension end 121*b* of the cantilever strip 121 are defined by the hollow region 120. The connection end 121*a* of the cantilever strip 121 is connected with the frame body 122. The suspension end 121*b* of the cantilever strip 121 is a free end. Since the cantilever strips 121 of the slim-type keyboard 1 are elastically restorable, the cantilever strips 121 can replace the scissors-type connecting element of the conventional keyboard.

In this embodiment, the cantilever strip 121 further comprises a U-shaped groove 121*c*. The U-shaped groove 121*c* is formed in an inner portion of the cantilever strip 121. A bottom side of the U-shaped groove 121*c* is located near the connection end 121*a* of the cantilever strip 121. The two lateral sides of the U-shaped groove 121*c* are extended along the two lateral sides of the suspension end 121*b* of the cantilever strip 121. Consequently, the U-shaped groove 121*c* opens to the suspension end 121*b* of the cantilever strip 121. Since the connection end 121*a* of the cantilever strip 121 is perforated by the bottom side and the two lateral sides of the U-shaped groove 121*c*, an inner suspension part 123 is defined. The traveling distance of the inner suspension part 123 and the traveling distance of the suspension end 121*b* are substantially equal. Consequently, when the pressed position A near the connection end 121*a* or the pressed position B near the suspension end 121*b* is pressed by the user's finger, the tactile feel of pressing the pressed position A and the tactile feel of pressing the pressed position B are substantially identical and not distinguished.

Please refer to FIGS. 2 and 3 again. The plural cantilever strips 121 are covered by the single first flexible layer 11. Moreover, the pressed regions 110 of the first flexible layer 11 are disposed over and aligned with the plural cantilever strips 121, respectively. Consequently, when one of the pressed regions 110 of the first flexible layer 11 is pressed, the corresponding cantilever strip 121 is pushed downwardly. In an embodiment, the first flexible layer 11 and the pressed frame 12 are combined together through a first adhesive 15.

Figure 4:
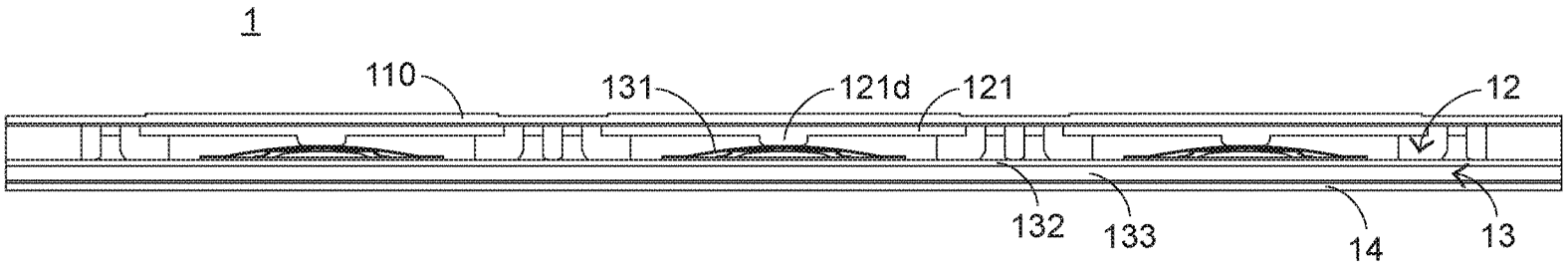
FIG. 4 is a cross-sectional view illustrating a portion of the slim-type keyboard according to the first embodiment of the present invention.

FIG. 4 is a cross-sectional view illustrating a portion of the slim-type keyboard according to the first embodiment of the present invention. Please refer to FIGS. 2, 3 and 4. The circuit board assembly 13 is disposed under the pressed frame 12. The circuit board assembly 13 comprises plural dome switches 131, a circuit board 132 and a supporting plate 133. The domes switches 131 are metal dome switches or rubber dome switches. The domes switches 131 are disposed on the circuit board 132. The plural cantilever strips 121 are disposed over and aligned with the plural dome switches 131, respectively. When one of the cantilever strips 121 is pushed downwardly, the corresponding dome switch 131 is triggered. Preferably, each cantilever strip 121 has a contacting part 121*d*. The contacting part 121*d* is protruded downwardly from the cantilever strip 121 and toward the circuit board assembly 13. Consequently, the dome switch 131 can be pushed more precisely and effectively. That is, while the pressed region 110 of the first flexible layer 11 is pressed by the user, the corresponding cantilever strip 121 of the pressed frame 12 is pushed downwardly to trigger the corresponding dome switch 131 of the circuit board assembly 13.

Preferably, the first flexible layer 11 is a one-piece structure, and the first flexible layer 11 is made of a plastic material, a leather material or a fabric material. As mentioned above, the first flexible layer 11 is a one-piece structure, and the top side of the pressed frame is covered by the first flexible layer 11. Consequently, when the slim-type keyboard 1 is used, the foreign dust particles or water drops will not drop down to the circuit board 132. In other words, the slim-type keyboard 1 has the waterproof and dust-proof benefits.

Moreover, the second flexible layer 14 is disposed under the circuit board assembly 13 for supporting the circuit board assembly 13. The supporting plate 133 is arranged between the circuit board 132 and the second flexible layer 14. The supporting plate 133 is used for supporting the circuit board 132. Consequently, the overall structure of the slim-type keyboard 1 becomes stronger and denser. Moreover, the circuit board assembly 13 and the second flexible layer 14 are combined together through a second adhesive 16. In an embodiment, the supporting plate 133 is a glass-reinforced epoxy laminate substrate (FR-4), a plastic substrate or a metal substrate, and the circuit board 132 is a membrane circuit board.

Figure 5:
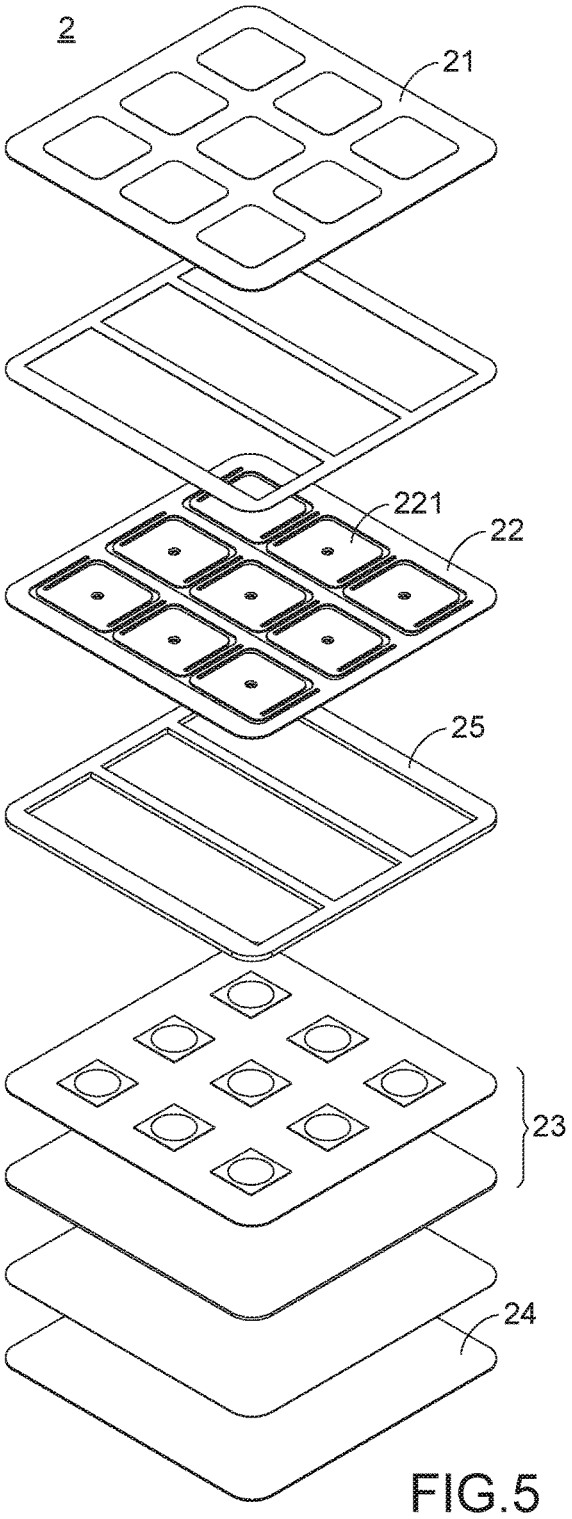
FIG. 5 is a schematic exploded view illustrating a portion of the slim-type keyboard according to a second embodiment of the present invention.

FIG. 5 is a schematic exploded view illustrating a portion of the slim-type keyboard according to a second embodiment of the present invention. Like the first embodiment, the slim-type keyboard 2 of this embodiment comprises a first flexible layer 21, a pressed frame 22, a circuit board assembly 23 and a second flexible layer 24. The structures and functions of the first flexible layer 21, the pressed frame 22, the circuit board assembly 23 and the second flexible layer 24 are similar to the corresponding components of the first embodiment, and are not redundantly described herein. In comparison with the first embodiment, the slim-type keyboard 2 of this embodiment further comprises a raised frame 25. The raised frame 25 is arranged between the pressed frame 22 and the circuit board assembly 23. Due to the raised frame 25, the pressed frame 22 and the circuit board assembly 23 are separated from each other by a predetermined distance. Consequently, when the key is pressed, the cantilever strip 221 of the pressed frame 22 has a sufficient traveling distance.

Figure 6:
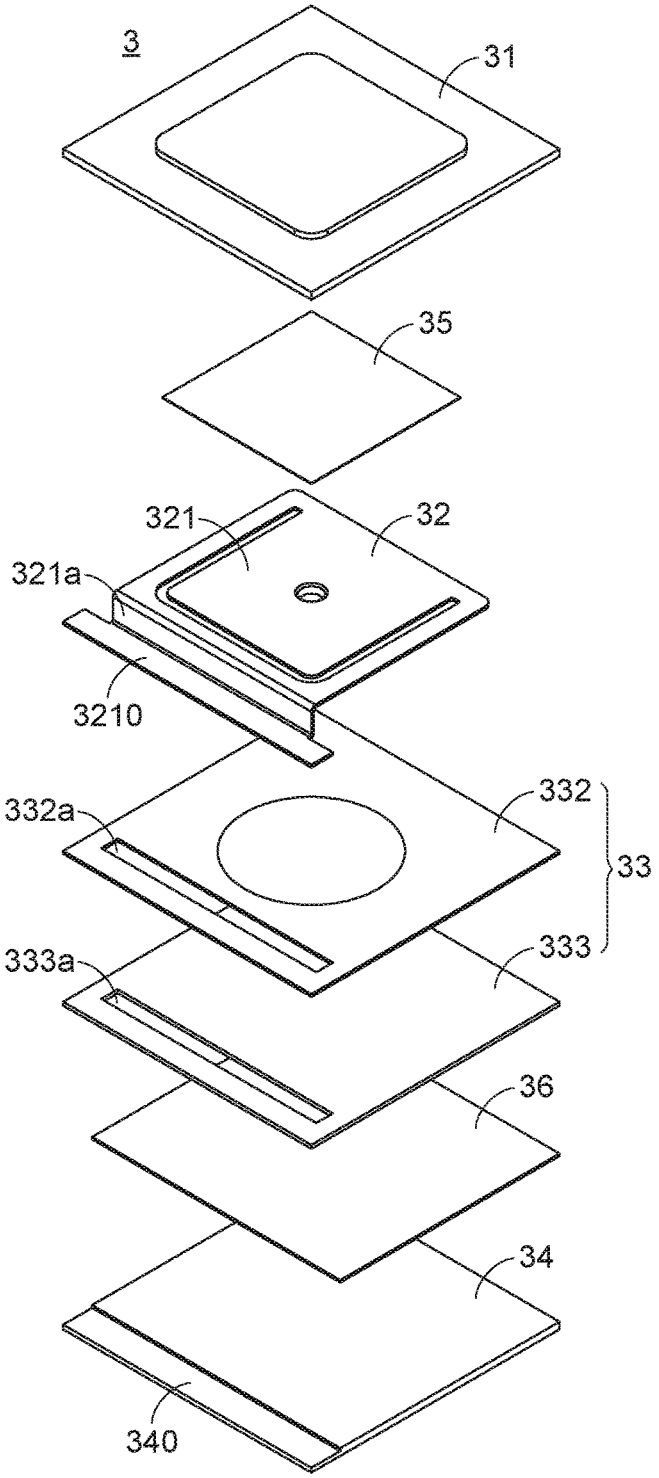
FIG. 6 is a schematic exploded view illustrating a portion of the slim-type keyboard according to a third embodiment of the present invention.

FIG. 6 is a schematic exploded view illustrating a portion of the slim-type keyboard according to a third embodiment of the present invention. For succinctness, only one pressed structure of the slim-type keyboard is shown. Like the first embodiment, the slim-type keyboard 3 of this embodiment comprises a first flexible layer 31, a pressed frame 32, a circuit board assembly 33 and a second flexible layer 34. The pressed frame 32 comprises plural cantilever strips 321. For succinctness, only one cantilever strip 321 is shown in FIG. 6. The circuit board assembly 33 comprises a circuit board 332 and a supporting plate 333. In comparison with the first embodiment, the circuit board 332 of this embodiment further comprises a first slot 332*a* and the supporting plate 333 further comprises a second slot 333*a*. Moreover, the cantilever strip 321 comprises a bent structure 3210. Preferably, after a connection end 321*a* of the cantilever strip 321 is penetrated downwardly through the first slot 332*a* and the second slot 333*a*, the connection end 321*a* is bent to form the bent structure 3210. The bent structure 3210 has a top surface and a bottom surface. The top surface of the bent structure 3210 is contacted with the supporting plate 333. The bottom surface of the bent structure 3210 is contacted with the second flexible layer 34. The second flexible layer 34 comprises a concave structure 340. The bent structure 3210 is accommodated within the concave structure 340. Due to this design, the pressed frame 32 is combined with the circuit board assembly 33. Like the above two embodiments, the pressed frame 32 is attached on the first flexible layer 31 through a first adhesive 35, and the circuit board assembly 33 is attached on the second flexible layer 34 through a second adhesive 36. Consequently, the slim-type keyboard 3 is assembled.

In the above three embodiments, the circuit board assembly 13, 23 or 33 comprises a circuit board (e.g., a membrane circuit board) and a supporting plate. In some embodiments, the supporting plate is not essential and is possibly omitted. Preferably, the circuit board has enhanced structural strength, and thus the circuit board has the function of the supporting plate. Under this circumstance, the circuit board is a glass-reinforced epoxy laminate substrate (FR-4) in replace of the membrane circuit board.

From the above descriptions, the slim-type keyboard of the present invention has specially-designed cantilever strips. When the cantilever strip is pressed by the user, the tactile feel of pressing the region near the connection end and the tactile feel of pressing the position near the suspension end are substantially identical. Moreover, the first flexible layer is a one-piece structure, and the top side of the pressed frame is covered by the first flexible layer. Consequently, the foreign dust particles or water drops will not drop down to the circuit board. Consequently, the slim-type keyboard has the waterproof and dust-proof benefits.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A slim-type keyboard, comprising:

a first flexible layer comprising plural pressed regions;

a pressed frame disposed under the first flexible layer, wherein the pressed frame comprises plural hollow regions and plural cantilever strips, and the plural cantilever strips are defined by the plural hollow regions, wherein each of the plural cantilever strips comprises a U-shaped groove, a connection end and a suspension end, and the U-shaped groove opens to the suspension end, wherein the plural cantilever strips are covered by the first flexible layer, and the pressed regions are disposed over and aligned with the corresponding cantilever strips, wherein when one of the plural pressed regions is pressed, the corresponding cantilever strip is pushed downwardly;

a circuit board assembly comprising a circuit board and plural dome switches, wherein the plural dome switches are disposed on the circuit board, and the plural cantilever strips are disposed over and aligned with the corresponding dome switches, wherein when one of the plural cantilever strips is pushed downwardly, the corresponding dome switch is triggered; and a second flexible layer disposed under the circuit board assembly, wherein a peripheral region of the first flexible layer and a peripheral region of the second flexible layer are attached on each other, an accommodation space is defined by the first flexible layer and the second flexible layer collaboratively, and the pressed frame and the circuit board assembly are accommodated within the accommodation space;

wherein the circuit board assembly further comprises a supporting plate, and the supporting plate is arranged between the circuit board and the second flexible layer, wherein the circuit board comprises a first slot, and the supporting plate comprises a second slot, wherein after the connection end of one of the plural cantilever strips is penetrated downwardly through the first slot and the second slot, the connection end is bent to form a bent structure, wherein the bent structure has a top surface and a bottom surface, the top surface of the bent structure is contacted with the supporting plate, and the bottom surface of the bent structure is contacted with the second flexible layer.

2. The slim-type keyboard according to claim 1, wherein the first flexible layer is a one-piece structure, and the first flexible layer is made of a plastic material, a leather material or a fabric material.

3. The slim-type keyboard according to claim 1, wherein the plural pressed regions are protruded upwardly from a top surface of the first flexible layer, and a symbol or a character is printed on the corresponding pressed region; or the plural pressed regions are formed on the top surface of the first flexible layer, and the symbol or the character is printed on the corresponding pressed region.

4. The slim-type keyboard according to claim 1, wherein the supporting plate is a glass-reinforced epoxy laminate substrate (FR-4), a plastic substrate or a metal substrate, and the circuit board is a membrane circuit board.

5. The slim-type keyboard according to claim 1, wherein the second flexible layer comprises a concave structure, and the bent structure is accommodated within the concave structure of the second flexible layer.

6. The slim-type keyboard according to claim 1, wherein the domes switches are metal dome switches or rubber dome switches.

7. The slim-type keyboard according to claim 1, wherein the slim-type keyboard further comprises a first adhesive, and the first adhesive is arranged between the first flexible layer and the pressed frame, wherein the first flexible layer and the pressed frame are combined together through the first adhesive.

8. The slim-type keyboard according to claim 1, wherein the slim-type keyboard further comprises a second adhesive, and the second adhesive is arranged between the circuit board assembly and the second flexible layer, wherein the circuit board assembly and the second flexible layer are combined together through the second adhesive.

9. The slim-type keyboard according to claim 1, wherein the circuit board is used as a supporting plate, and the supporting plate is a glass-reinforced epoxy laminate substrate (FR-4), wherein the plural dome switches are disposed on the supporting plate.

* * * * *